US006608609B1

(12) United States Patent
Setoguchi et al.

(10) Patent No.: US 6,608,609 B1
(45) Date of Patent: Aug. 19, 2003

(54) METHOD FOR DRIVING PLASMA DISPLAY PANEL

(75) Inventors: Noriaki Setoguchi, Kawasaki (JP); Shigeharu Asao, Kawasaki (JP); Yoshikazu Kanazawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/310,204

(22) Filed: May 12, 1999

(30) Foreign Application Priority Data

Jun. 30, 1998 (JP) ..... 10-184520

(51) Int. Cl.[7] ..... G09G 3/28
(52) U.S. Cl. ..... 345/60; 345/66
(58) Field of Search ..... 345/60, 66

(56) References Cited

U.S. PATENT DOCUMENTS

| | | | | |
|---|---|---|---|---|
| 4,296,357 A | | 10/1981 | Hirayama et al. | 315/169.4 |
| 5,663,741 A | * | 9/1997 | Kanazawa | 345/66 |
| 5,874,932 A | * | 2/1999 | Nagaoka et al. | 345/60 |
| 5,963,184 A | * | 10/1999 | Tokunaga et al. | 345/60 |
| 6,320,560 B1 | * | 11/2001 | Sasaki et al. | 345/60 |

FOREIGN PATENT DOCUMENTS

| | | |
|---|---|---|
| EP | 0 052 918 | 6/1982 |
| EP | 0 101 790 | 3/1984 |
| EP | 0 657 861 | 6/1995 |
| EP | 0 836 171 | 4/1998 |
| EP | 0 855 692 | 7/1998 |
| JP | 54-51330 | 4/1979 |
| JP | 55-22773 | 2/1980 |
| JP | 62-42191 | 2/1987 |
| JP | 2-220330 | 9/1990 |
| JP | 4-195188 | 1/1992 |
| JP | 5-2993 | 1/1993 |
| JP | 5-313598 | 11/1993 |
| JP | 7-134565 | 5/1995 |
| JP | 8-160908 | 6/1996 |
| JP | 8-212930 | 8/1996 |
| JP | 9-160525 | 6/1997 |
| JP | 10-228257 | 8/1998 |
| JP | 11-143424 | 5/1999 |

OTHER PUBLICATIONS

Sano Y. et al.: "A Full–Color Surface–Discharge AC Plasma TV Display" SID International Symposium Digest of Technical Papers, Anaheim, May 6–10, 1991, No. vol. 22, May 6, 1991 pp. 728–731, Society for Information Display ISSN: 0097–966X.

J.R. Beidl et al. "Write and Erase Pulses 8–13 of Opposite Polarities", IBM Technical Disclosure Bulletin, vol. 23, No. 12, May 1981, pp. 5442–5443.

S. Umeda et al., "Improved Operating Range 9, 10 of AC Plasma Display Panel", Fujitsu–Scientific and Technical Journal, vol. 12, No. 4, Dec. 1976 (1976–12) pp. 153–163.

* cited by examiner

*Primary Examiner*—Richard Hjerpe
*Assistant Examiner*—Kevin M. Nguyen
(74) *Attorney, Agent, or Firm*—Staas & Halsey, LLP

(57) ABSTRACT

A method for driving a plasma display panel constituted by a group of cells each having a memory function, comprising arranging first and second electrodes in parallel with one another for each display line on a first substrate, arranging third electrodes on a second substrate opposing the first substrate in such a manner as to cross the first and second electrodes, and repeating light emission display by utilizing a selective address discharge for generating wall charges in cells selected by either one of the first and second electrodes and by the third electrodes and a sustain discharge executed repeatedly for the cells in which the wall charges are generated, is disclosed in which a pulse having a higher voltage than a priming pulse for executing a priming discharge after the activation of the cells is applied between the first and second electrodes only at the time of activation of the cells.

13 Claims, 15 Drawing Sheets

METHOD FOR DRIVING PLASMA DISPLAY PANEL

BACKGROUND OF THE INVENTION

1. Field of the Invention

The present invention relates to a technology for driving a display panel constituted by a group of memory cells having a memory function as display elements. More particularly, the present invention relates to a method for driving a plasma display panel, which is directed to reducing background light emission of an alternating current (AC) type plasma display panel. (Generally, a plasma display apparatus, inclusive of the plasma display panel is referred to as a "PDP".)

The AC type plasma display panel, of this kind sustains discharges and carries out light emission display by alternately applying voltage waveforms of a plurality of pulses to two electrodes for sustaining this discharge (i.e., sustain electrodes). A discharge (lighting) operation for every discharge period finishes within a few micro-seconds (is) after the application of pulses. Ions defined as positive charges that are generated by this discharge are accumulated over an insulating layer on the electrode to which a negative voltage is applied. Similarly, electrons as negative charges are accumulated over an insulating layer on the electrode to which a positive voltage is applied.

Therefore, when wall charges are generated by causing the discharges by the pulses, (write pulses) each having a relatively high voltage, (write voltage) and then the pulses (sustain discharge pulses, that is, "sustain pulses"), each having a voltage lower than that of each of the write pulses (sustain discharge voltage) and an opposite polarity to each of the write pulses, are applied to the electrodes, electric charges generated by the sustain pulses are superimposed on the wall charges previously accumulated by the write pulses so as to enhance the accumulated wall charges.* As a result, the potential of the wall charges with respect to a discharge space becomes large and, eventually the above voltage exceeds a discharge threshold voltage at which the discharge starts. In other words, given cells that once executed the write discharge and have formed the wall charges have characteristics such that of these cells sustain the discharge when the sustain discharge pulses are alternately applied thereto in the opposite polarities. A phenomenon having the above characteristics is referred to as a "memory effect"or "memory drive". The AC type plasma display panel carries out display by utilizing this memory effect.

2. Description of the Related Art

The AC type plasma display panels can be Hi . *classified into a two-electrode type which executes selective discharge. (i.e., selective address discharge) and sustain discharge by two electrodes, and a three electrode type which executes the addressing discharge by Utilizing a third-electrode. In color plasma display panels for effecting multi-gradation display., a phosphor inside the cell is excited by ultra-violet rays generated by the discharge between different kinds of electrodes, but this phosphor involves the problem that it is extremely fragile against the impact of the ions defined as the positive charges that are generated simultaneously by the discharge (that is, the phosphor is sensitive to the impact of the ions). Since the former two-electrode type plasma display panel described above employs the construction in which the ions are allowed to-collide directly with the phosphor, the life of the phosphor is likely to become shorter. To avoid this problem, the latter three-electrode type plasma display panel utilizing a surface discharge (that is, a surface discharge type plasma display panel which is carried out between, different electrodes that are located in the same plane), has been used generally in the color plasma display panels.

Here, in order to enable the problems of the driving method of the plasma display panel, according to the prior art systems, to be more easily understood, the construction of a conventional plasma display panel and its driving method will be explained with reference to FIGS. 1 to 3 of the later-appearing "Brief Description of the Drawings".

An AC type color plasma display panel which is a three-electrode and a surface discharge type, such as the one shown in a schematic plan view of FIG. 1, has been known in the past., In FIG. 2, a schematic sectional view of cells shown in FIG. 1 in a horizontal direction is illustrated.

A panel 1 comprises two glass substrates (that is, a front glass substrate 8 and a back glass substrate 9). The front glass substrate 8 defined as the first glass substrate includes first and second electrodes (X electrodes 2, Y electrodes 3-1 to 3-N (where N is an arbitrary positive integer of 2 or more than 2)), which are both defined as parallel sustain electrodes. Each of these electrodes comprises a transparent electrode 14 and a bus electrode 13.. The transparent electrode 14 is made of an ITO (a transparent conductive film consisting of indium oxide as the main component), etc., because it has a role of transmitting the reflected rays of light from the phosphor 12. The bus electrode 13 must be fabricated with a low resistance value so as to prevent a voltage drop due to the resistance of these electrodes, and is usually made of Cr or Cu. These electrodes are covered with a dielectric layer (e.g., glass) 10, and a MgO (magnesium oxide) film 11 is formed as a protective film on the discharge surface. Third electrodes (addressing electrodes A1 to AM (where M is an arbitrary positive integer of 2 or more than 2) are formed on the back glass substrate 9 defined as the second glass substrate opposing the first glass substrate in such a manner as to orthogonally cross the sustain electrodes. The addressing electrodes A1 to AM are covered with the dielectric layer 10 to form barriers 6 thereon, and phosphors 12 having red, green and blue light emission characteristics are formed between the barriers 6. The two glass substrates are assembled in such a manner that the portions of ridges of the barriers 6 are in close contact with the surface of the MgO film 11.

The selective address discharge for selecting cells 5 is executed by selecting the addressing electrodes and the Y electrodes. The sustain discharge is effected between the X electrode and the Y electrode. In the panel 1 having such a construction, the sustain discharge is effected in narrower gaps between the adjacent sustain electrodes (which gaps are referred to as "discharge slits") but is not effected in the broader gaps between the adjacent sustain electrodes (which-are referred to as. "opposite slits").

The sustain electrodes are arranged on the entire surface:in the sequence of the X electrode 2 of the first display line, the Y electrode 3-1 of the first display line, the X electrode 2 of the second display line, the Y electrode 3-2 of the second display line, the X electrode 2 of the third display line, the Y electrode 3—3 of the third display line, and so forth.

In FIG. 3, a timing chart useful for explaining the method for driving the plasma display panel according to the prior art when the-plasma display driving apparatus described above or the like is used, is illustrated.

The timing chart of FIG. 3 shows typically the configuration of frames necessary for forming the display screen of the plasma display panel and voltage waveforms of various driving voltage pulses for each of the electrodes. Generally, each frame is divided into a plurality of subframes for effecting multi-gradation display by setting mutually different light emission periods (strictly speaking, sustain discharge periods). Each of these subframes includes an initialization period (reset period) of the wall charges, an addressing period (abbreviated to "addr. period" in FIG. 3) for executing selective write discharge (that is, selective address discharge) of display data for the selected cell after the execution of the reset period, and a sustain discharge period (abbreviated to "sust. discharge period" in FIG. 3) for repeatedly executing light emission display of the selected cell by utilizing the sustain discharge for sustaining this addressing discharge.

The explanation will be given in further detail. In the priming discharge period which is executed at least once for each frame, an all-cell write pulse having a voltage Vw higher than the discharge start voltage (i.e., discharge threshold voltage) is applied to the X electrodes only at the time of activation of the cells, and a voltage Vaw for stably executing surface discharge on the X and Y electrodes (e.g., Vw/2) is applied to the addressing electrodes so that the stable whole surface write/self-erase discharge can be carried out.

When the all-cell write pulse falls, the wall voltage due to the wall charges generated between the. X and Y electrodes becomes larger than the discharge start voltage, and the all-cell self-erase discharge occurs. Practically, however, all the wall charges having a negative polarity are not completely neutralized and a limited quantity of the wall charges remain in the cells. Here, the term "wall charges having a negative polarity" means the wall charges under the state in which the negative wall charges remains in the X electrode and the positive wall charges remain in the Y electrode. The all cell write discharge and the all-cell self-erase discharge due to the application of the all-cell write pulses have the function of generating background light emission of the display screen of the plasma display panel, and such a function is generally known as a "priming effect". In this sense, the all-cell write pulse is referred to as "priming pulse", and the all-cell write discharge by this priming pulse is referred to as "priming discharge".

In the second addressing period of each subframe, an address pulse having a voltage Va necessary for executing a write operation of display data by turning on the selected cell. (light emission display) is applied to the addressing electrode and an addressing pulse having a voltage Vx is applied to the X electrode. Further, the addressing pulse having a voltage Va is applied to the addressing electrode and then a scanning pulse having a voltage −Vy is applied to the Y electrode.

In the third sustain discharge period of each subframe, a train of sustain pulses having a voltage Vs for effecting sustain discharge to sustain the address discharge are applied to the X electrodes, and a train of sustain pulses, the phase of which is deviated by 180° (½ cycle) from that of the former sustain pulses and which have a voltage Vs, are applied to the Y electrode. Further, a voltage pulse having a voltage Ve is applied to the address electrode in synchronism with the rise of the first sustain pulse, and this voltage pulse is held until the sustain discharge period is terminated.

As described above, in the method for driving the plasma display panel according to the prior art shown in FIG. 3, the priming pulse larger than the discharge start voltage is applied once for each subframe (or for each frame when multi-gradation display is not effected) to the X electrode or to the Y electrode in the first reset period. Further, in order to insure stable address discharge in the addressing period, a predetermined voltage is applied to the addressing electrode in the first reset period of each subframe.

However, when the method for driving the plasma display panel described above is employed, the priming discharge must be generated at the time of turn-on of the power from the state in which any priming does not exist. Because the voltage necessary for this purpose is applied, a discharge larger than necessary develops in the priming discharge of the next subframe, and the rise of background light emission of the display screen takes place disadvantageously on the other hand, it would be possible, in principle, to execute the erase discharge by a large width erase pulse (i.e., long erase pulse) or a small width erase pulse (i.e., short erase pulse) for only those cells which have executed the sustain discharge. When the large width erase pulse or the small width erase pulse is used, however, a driving margin that represents the relationship of the voltage Vx of the addressing pulse and the voltage Vy of the scan pulse becomes extremely small, and the operation becomes unstable against the change with the lapse of time or the change of temperature.

SUMMARY OF THE INVENTION

The present invention has been completed in view of the problems described above, and is directed to-providing a method for driving a plasma display panel which can restrain the rise of background light emission brought forth by the occurrence of a discharge larger than necessary due to the priming discharge.

To accomplish the object described above, the present invention provides a method for driving an AC type plasma display panel which comprises arranging first electrodes and second electrodes in parallel with one another for each display line; arranging third electrodes in such a manner as to cross the first and second electrodes; and repeatedly executing light emission display by utilizing a selective address discharge for generating wall charges in cells selected by either one of the first and second electrodes and by the third electrode and a sustain discharge executed repeatedly for the cells in which the wall charges are generated.

In this method for driving the plasma display panel, each of a plurality of frames forming the display screen of the plasma display panel comprises a plurality of subframes each having predetermined luminance, and each of these subframes has a period in which the selective address discharge is executed and a period in which the sustain discharge is executed after the selective address discharge, and has, on the other hand, a period in which a priming discharge is executed at least once for each frame. Further, a pulse having a voltage higher than the priming pulse for executing a subsequent priming discharge is applied between the first and second electrodes so as to execute the priming discharge.

As described already, the priming discharge must be generated at the time of turn-on of the power source, that is, at the time of activation of the cells, from the state in which no priming exists. If a priming pulse having a low voltage is applied at this time, the priming discharge does not develop in some cases. Therefore, the method for driving a plasma display panel according to the present invention applies the priming pulse having a higher voltage than the voltages of subsequent priming pulses only at the time of activation of the cells, and in the subsequent priming discharge, a priming pulse having a lower potential is applied. Because the occurrence of a discharge which is larger than necessary is restrained in this way, background light emission can be reduced much more than in the prior art systems.

BRIEF DESCRIPTION OF THE DRAWINGS

The above object and features of the present invention will be more apparent from the following description of the preferred embodiments with reference to the accompanying drawings, wherein.

DESCRIPTION OF THE PREFERRED EMBODIMENTS

Preferred embodiments of the present invention will be explained hereinafter in further detail with reference to the accompanying drawings (FIGS. 4 to 21).

Figure 1:
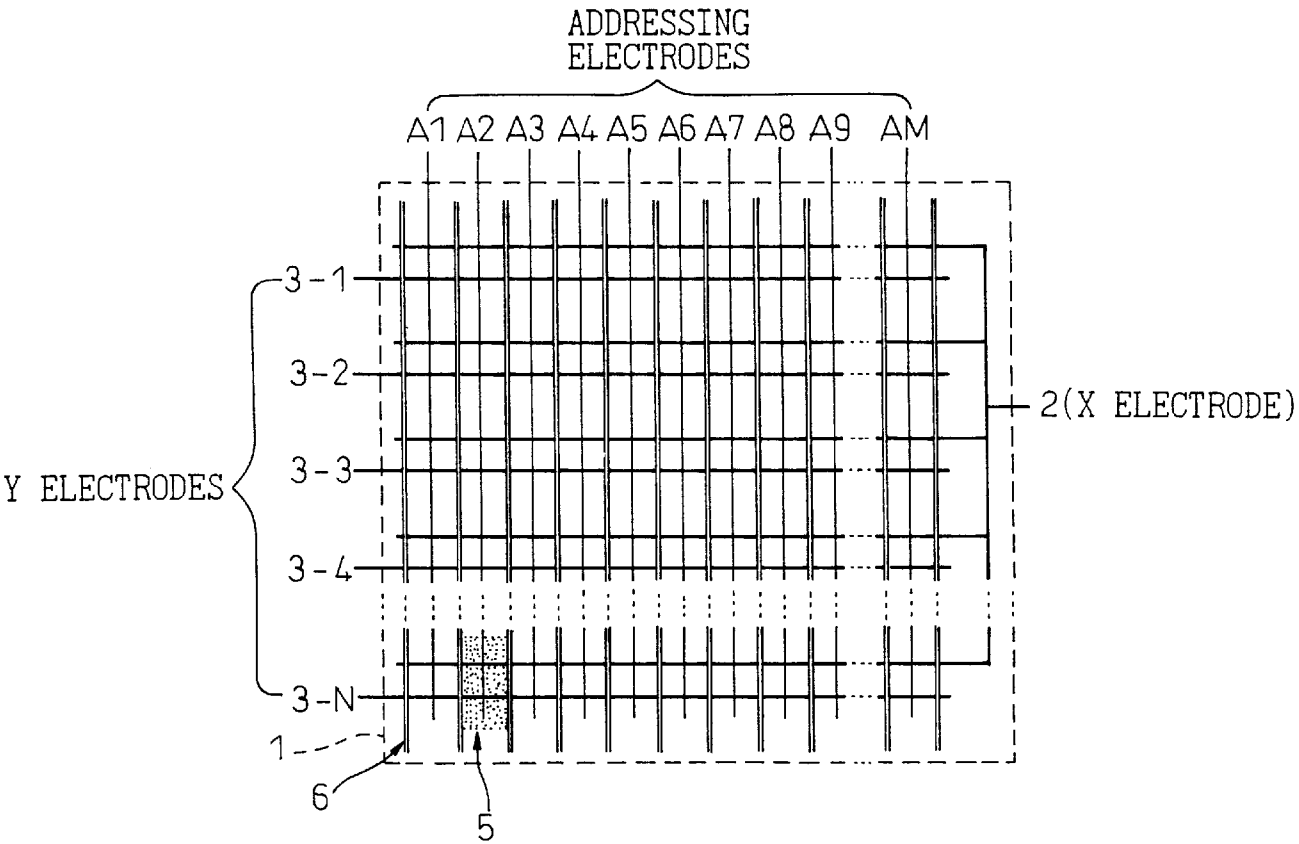
FIG. 1 is a plan view showing the schematic construction of a conventional surface discharge type plasma display panel.
Figure 2:
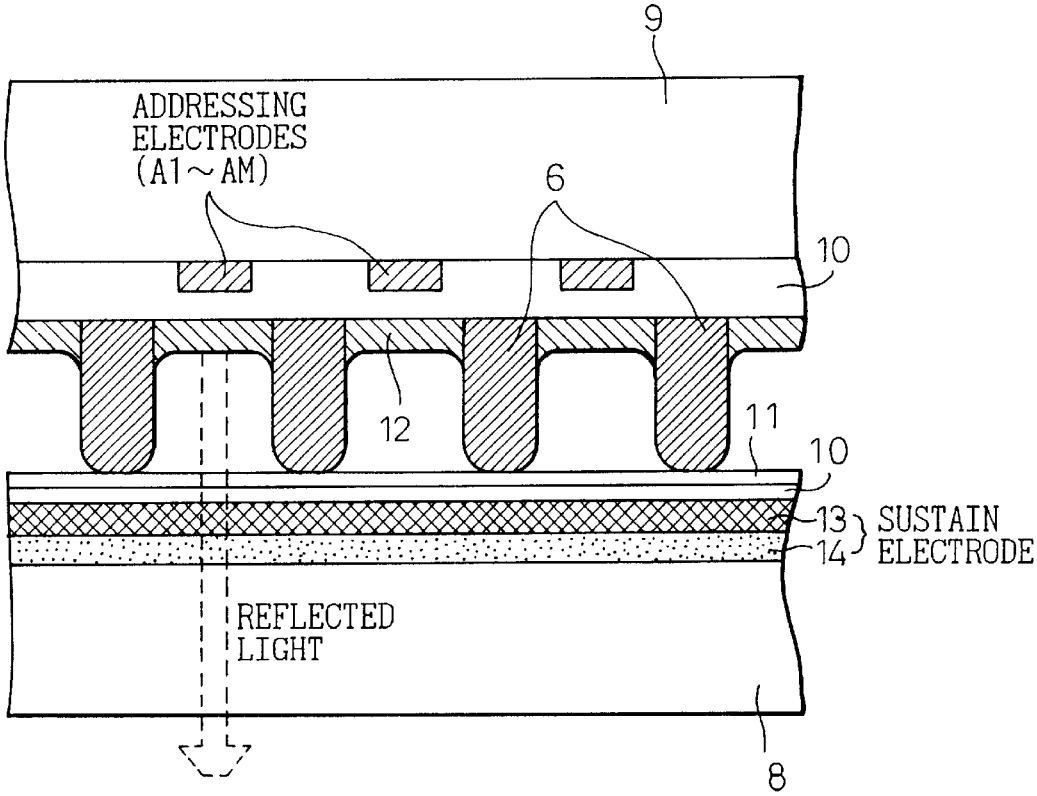
FIG. 2 is a schematic sectional view showing the basic construction of the X cells shown in FIG. 1.
Figure 3:
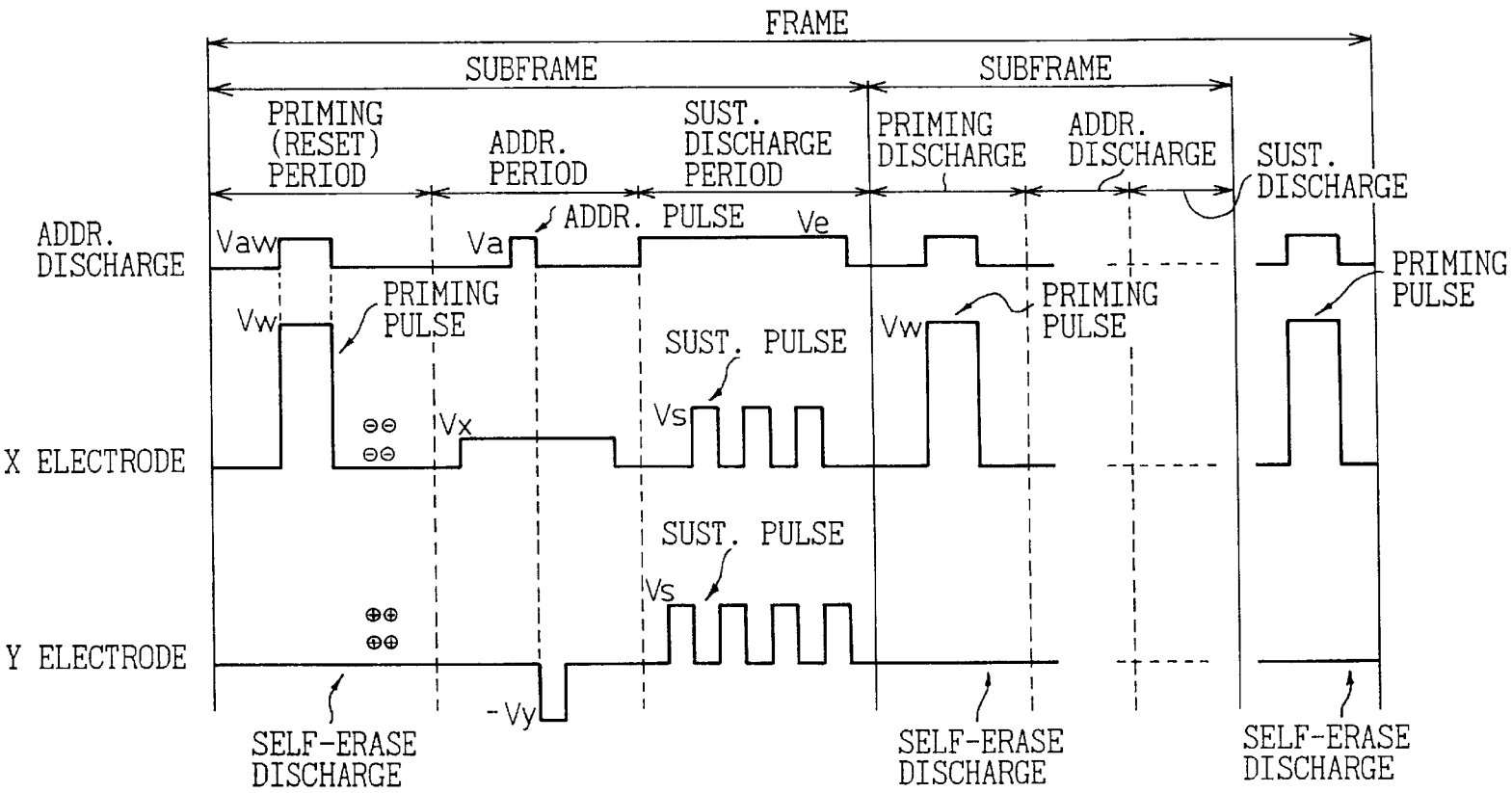
FIG. 3 is a timing chart useful for explaining a method for driving a plasma display panel according to the prior art.
Figure 4:
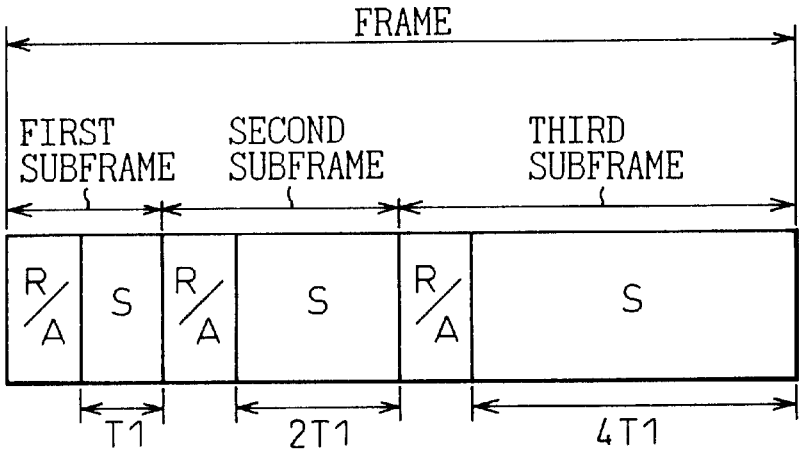
FIG. 4 is a diagram showing a structural example of the frame used for preferred embodiments of the present invention.

FIG. 4 is a diagram showing a structural example of the frame used in the preferred embodiments of the present invention. However, the structure is shown hereby in a simplified form.

As shown in FIG. 4, one frame for forming one display screen is divided into a plurality of subframes such as first to third subframes. Sustain discharge periods of these first to third subframes are T1, T2 and T3, respectively. In each of these subframes, the sustain discharge is executed the number of times that is proportional to the length of the sustain discharge period. Display data having luminance of eight gradations can be displayed by executing such sustain discharges. Similarly, when the number of subframes is set to 8, the sustain discharge periods of these subframes are T1, 2T1, 4T1, 8T1, 16T1, 32T1, 64Tl and 128T1, respectively, and display data having luminance of 256 kinds of gradations can be displayed.

Each of the subframes has a reset period, an addressing period (sometimes abbreviated to "addr. period" in the drawings) and together designated R/A and a sustain discharge period (sometimes abbreviated to "sust. discharge period" in the drawings), and designated S for repeatedly executing light emission display of the selected cell by utilizing the sustain discharge for sustaining the addressing discharge.

Figure 5:
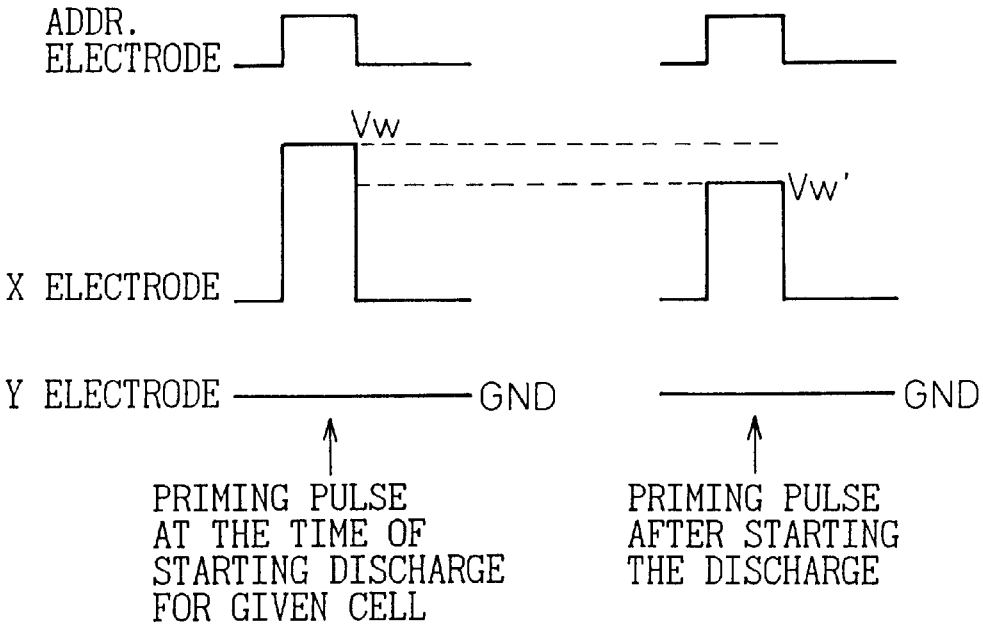
FIG. 5 is a block diagram showing the first embodiment of the present invention.

FIG. 5 shows the first embodiment of the present invention. Hereinafter, the same reference numeral will be used to identify the same constituent element already described.

In the first embodiment shown in FIG. 5, a priming pulse (voltage Vw) having a higher potential than the voltage Vw' of the priming pulse, that is repeatedly applied after this -priming pulse, is applied to the X electrode only under the state in which no priming at all exists at the time of activation of the cells (that is, at the time of starting discharge for a given cell). In this way, the discharge scale of the priming pulse is optimized and the rise of background light emission can be prevented.

Figure 6:
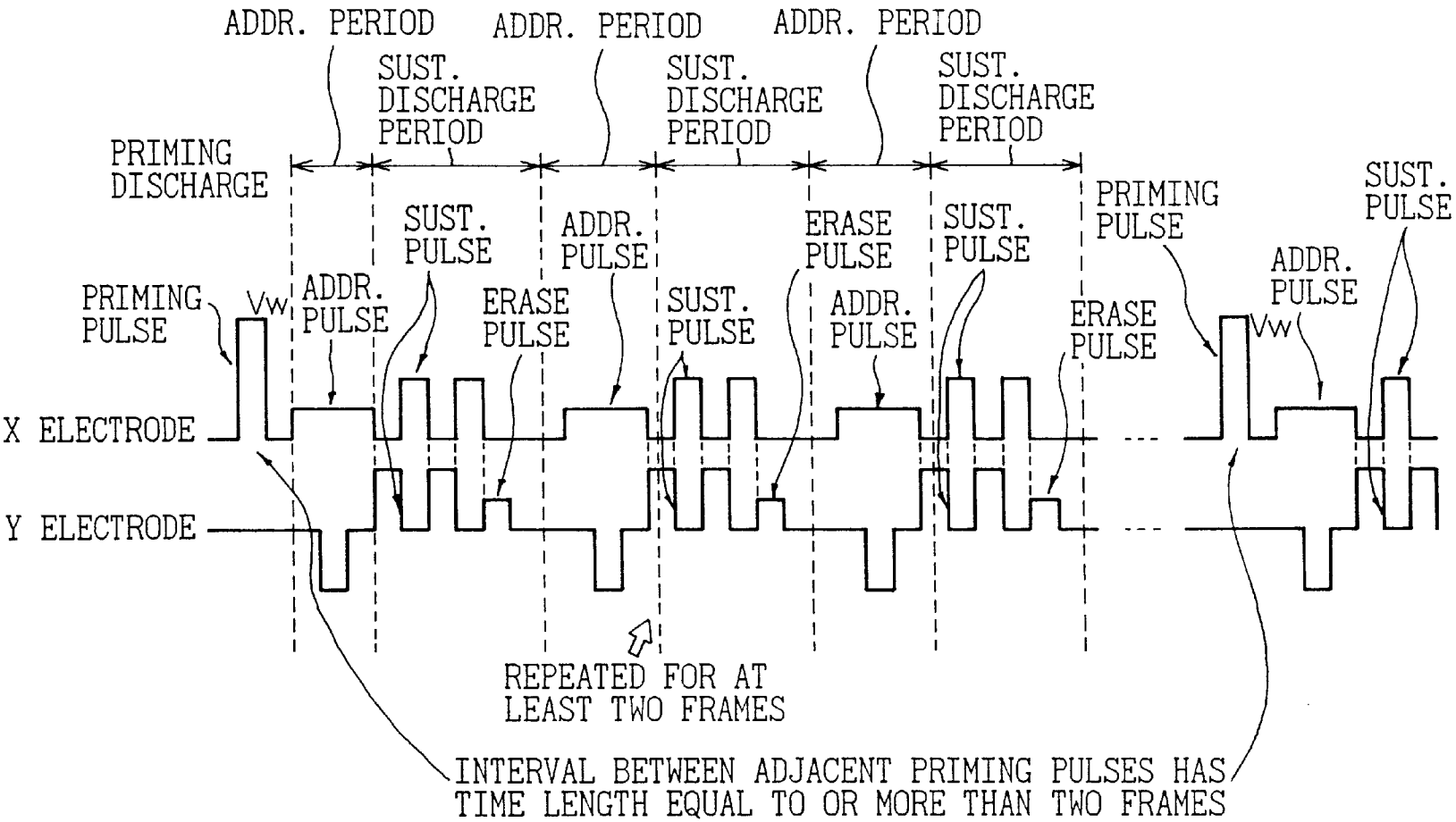
FIG. 6 is a timing chart useful for explaining a method for driving a plasma display panel according to the second embodiment of -the present invention.

FIG. 6 is a timing chart useful for explaining the method for driving a plasma display panel according to the second embodiment of the present invention.

In the second embodiment shown in FIG. 6, the priming discharge is executed for all the cells of at least one display line only once for at least two frames. In other words, the interval for applying the priming pulse of the voltage Vw for executing the priming discharge is set to at least two frames.

Because the interval of the priming pulse is set to an arbitrary value of at least two frames as described above, luminance of background light emission can be reduced more greatly than when the timing pulse is applied for each frame.

Figure 7:
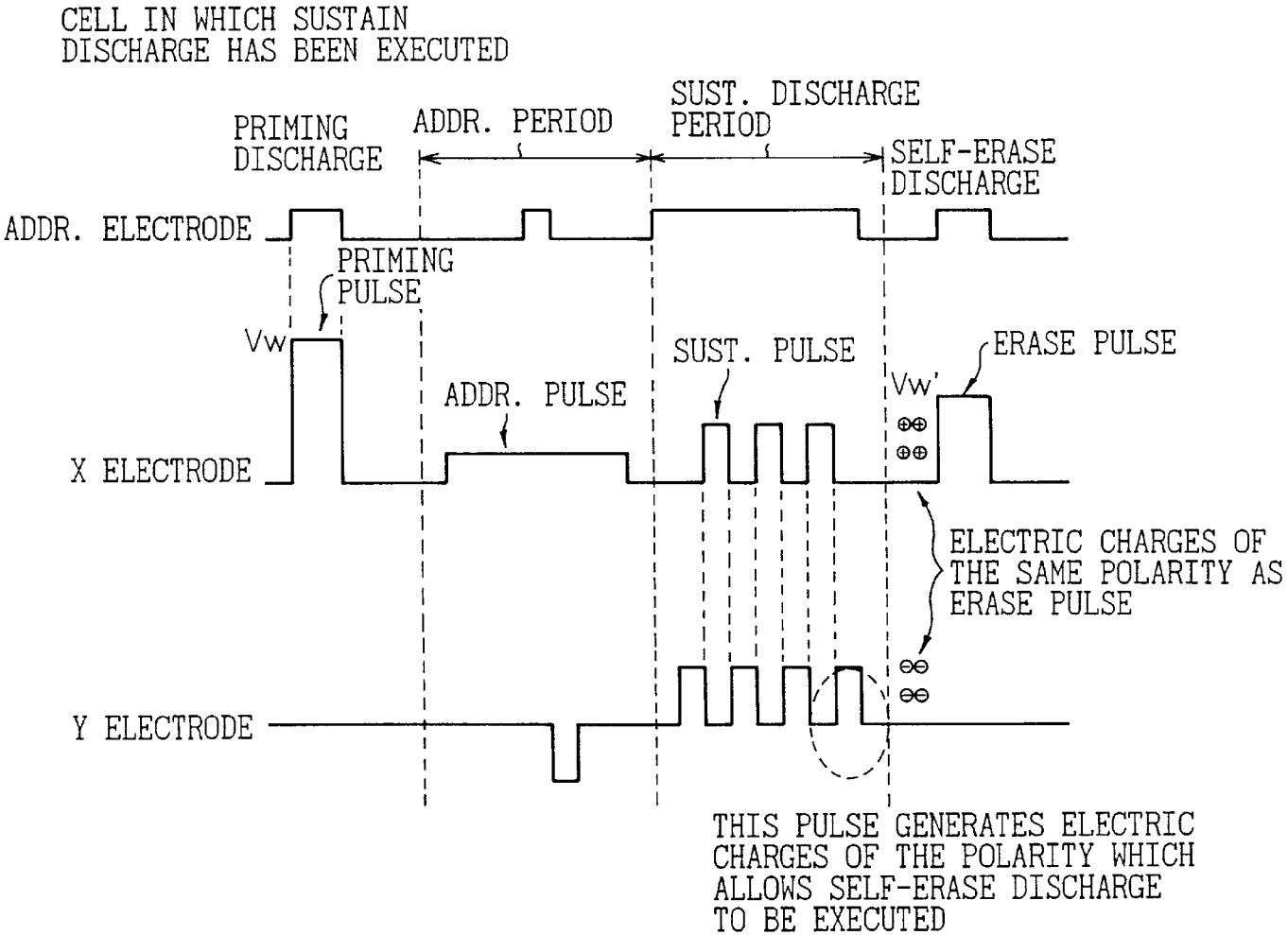
FIG. 7 is a timing chart useful for explaining a method for driving a plasma display panel according to the third embodiment of the present invention.
Figure 8:
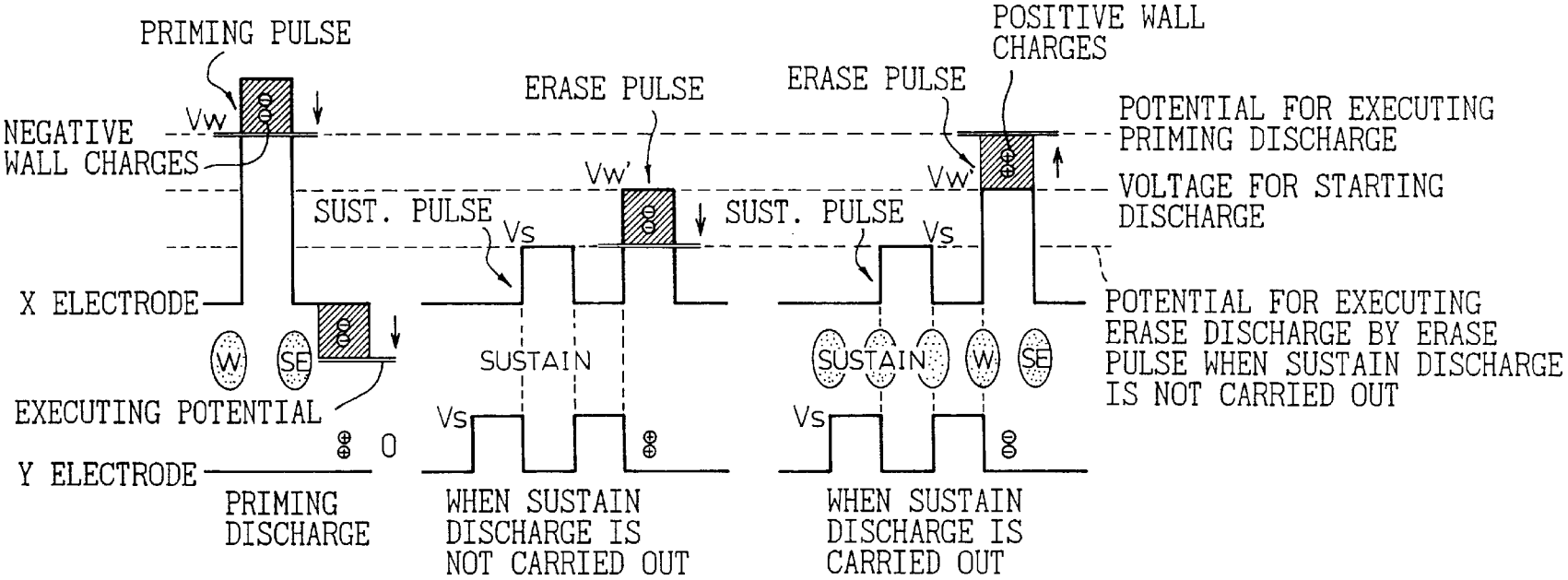
FIG. 8 is a diagram showing the changes of a selferase discharge potential when a sustain discharge is effected and when the sustain discharge is not effected in the embodiment of the present invention shown in FIG. 7.
Figure 9:
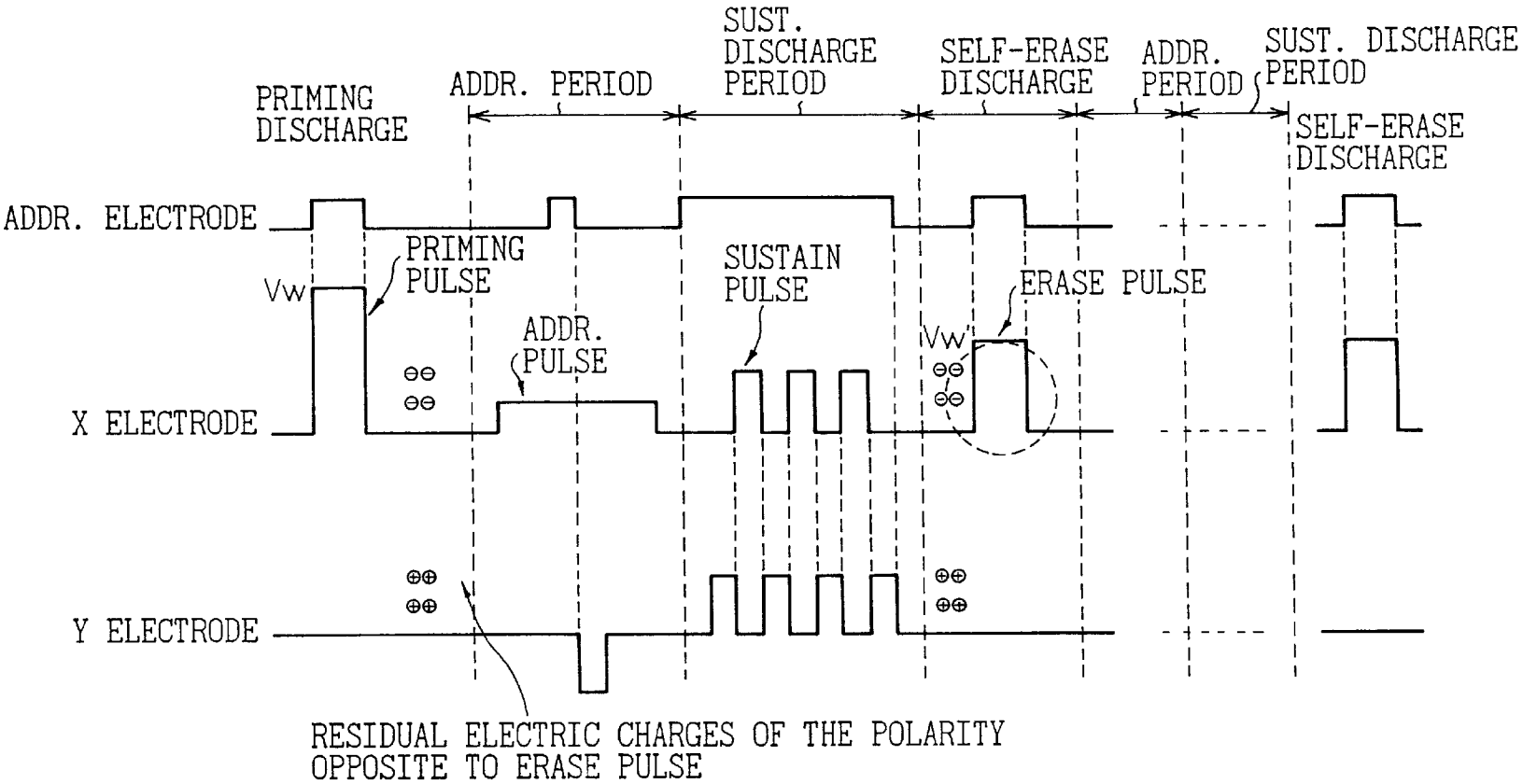
FIG. 9 is a diagram showing the mode of the residual wall charges having a negative polarity when the sustain discharge is not executed in the embodiment of the present invention shown in FIG. 7.

FIG. 7 is a timing chart useful for explaining the method for driving a plasma display panel according to the third embodiment of the present invention, and FIG. 8 shows the changes in the self-erase discharge potentials when the sustain discharge is executed, in the embodiment shown in FIG. 7, and when it is not executed. FIG. 9 shows the state in which the wall charges of a negative polarity remain when the sustain discharge is not executed in the embodiment shown in FIG. 7.

In the third embodiment shown in FIG. 7, the final pulse of the sustain discharge period is supplied to the Y electrode so as to execute the self-erase discharge for those cells which have executed the sustain discharge, after the priming pulse for executing the all-cell self erase discharge is applied to the X electrode. In this way, the execution potential of the erase pulse is regulated.

The explanation will be given in further detail. The all-cell self-erase discharge is executed at the point when the priming pulse of the voltage Vw applied by the first priming discharge of each frame falls, and the negative wall charges (⊖) remain on the X electrode while the positive wall charges (⊕) remain on the Y electrode. (In other words, the wall charges of a negative polarity with respect to the erase pulse remain.) Further, the self-erase discharge can be generated, for the cells that have executed the sustain discharge in the sustain discharge period of each subframe, by superposing the wall voltage of the wall charges of the positive polarity with respect to the erase pulse formed finally in the sustain pulse, with the voltage Vw' of this erase pulse of the sustain pulse that is finally formed, and then executing the discharge. Here, symbols "W", "SE" and "SUSTAIN" in FIG. 8 represent the write discharge, the self-erase discharge and the sustain discharge, respectively..

On the other hand, the negative wall charges formed by the priming discharge remain on the X electrode while the positive wall charges remain on the Y electrode for the cells that have not executed the sustain discharge, as shown in FIGS. 7 and 9. In this case, the wall voltage due to the wall charges is subtracted from the voltage Vw' of the erase pulse. Therefore, the write discharge and the self-erase discharge are not executed for the cells that have not executed the sustain discharge, during the reset period of the subframes.

Figure 10:
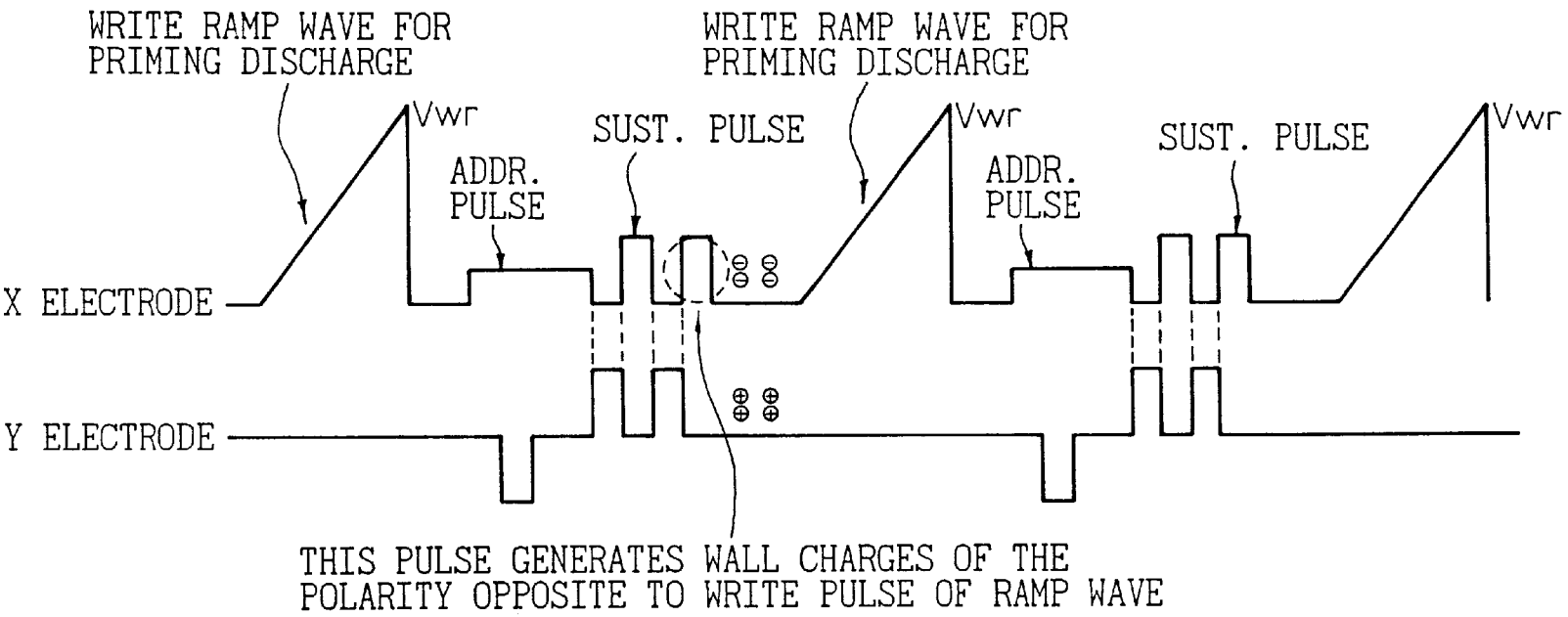
FIG. 10 is a timing chart useful for explaining a method for driving a plasma display panel according to the fourth embodiment of the present invention.

FIG. 10 is a timing chart useful for explaining the method for driving a plasma display panel according to the fourth embodiment of the present invention.

In the embodiment shown in FIG. 10, a write pulse of a waveform in which a voltage is varied, with time, such as a slope write pulse (e.g., as a specific example, a pulse of a ramp waveform having a gentle slope and a peak voltage Vwr) is applied to the X electrode. When such a write pulse of a gentle slope is applied, a weak discharge is executed repeatedly with successive rises of the voltage of the slope write pulse. At this time, the time during which the rectangular write pulse having the peak voltage Vwr is applied can be substantially reduced by setting the polarity of the wall charges, existing immediately before the slope write pulse, to the opposite polarity relatively to the polarity of the slope write pulse.

On the other hand, when the slope write pulse is generated by providing the resistance to the output side of the driving circuit, stable driving of the plasma display panel can be achieved while preventing a large drop due to the discharge.

Next, some modified embodiments associated with the fourth embodiment shown in FIG. 10 will be explained with reference to FIGS. 11 to 16.

FIGS. 11 to 16 respectively illustrate first to sixth concrete examples of driving voltage waveforms for generating wall charges having a negative polarity relatively to the slope write pulse of the ramp waveform shown in FIG. 10.

Figure 11:
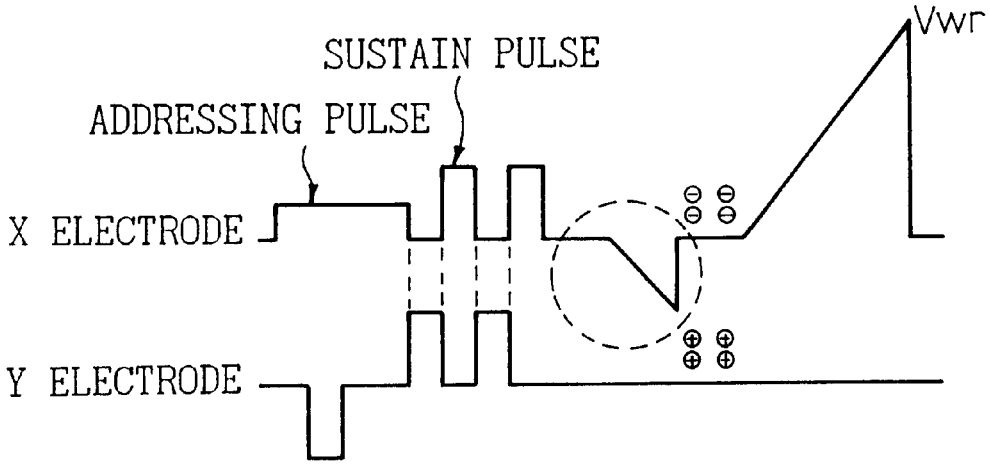
FIG. 11 is a driving voltage waveform diagram showing a first concrete example for .forming the wall charges having a negative polarity relatively to a write pulse of a ramp wave in the embodiment of the present invention shown in FIG. 10.

In the first concrete example shown in FIG. 11, an erase pulse of a ramp waveform having a gentle slope (i.e., a slope erase pulse) and having a polarity opposite to the polarity of the slope write pulse (as in FIG. 10) is applied to the same electrode (X electrode) as the electrode to which the slope write pulse is applied, after the sustain discharge is executed. Because the erase discharge is executed by such an erase slope pulse, wall charges having the same polarity as that of the wall charges generated by the slope write pulse are allowed to remain.

Figure 12:
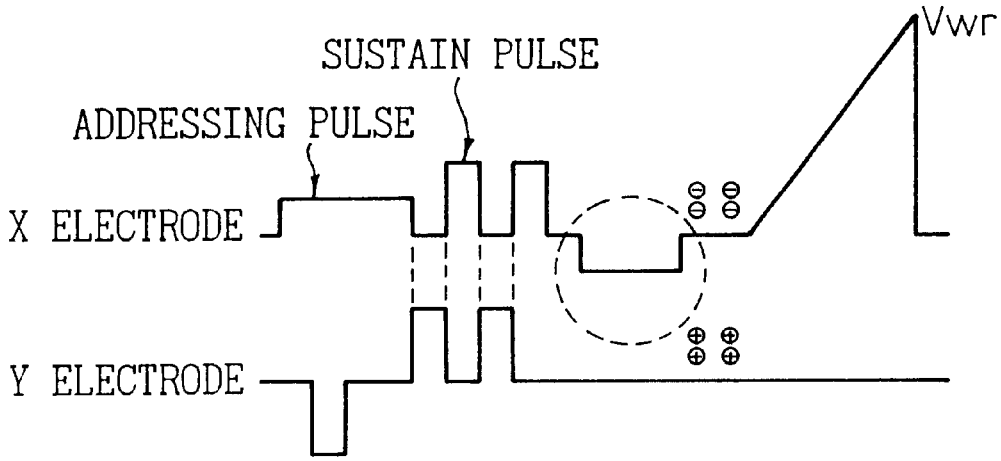
FIG. 12 is a driving voltage waveform diagram showing a second concrete example for forming the wall charges having a negative polarity relatively to a write pulse of a ramp wave in the embodiment of the present invention shown in FIG. 10.

In the second concrete example shown in FIG. 12, the erase discharge is executed by applying a large width erase pulse (i.e., a long erase pulse), which has an opposite polarity to that of the slope write pulse (e.g., of the ramp waveform and having the gentle slope, shown in FIG. 10), to the same electrode (X electrode) to which the slope write pulse is applied, after the sustain discharge is executed. Because the erase discharge is executed by such a large width erase pulse, wall charges having the same polarity as that of the wall charges generated by the slope write pulse are allowed to remain.

Figure 13:
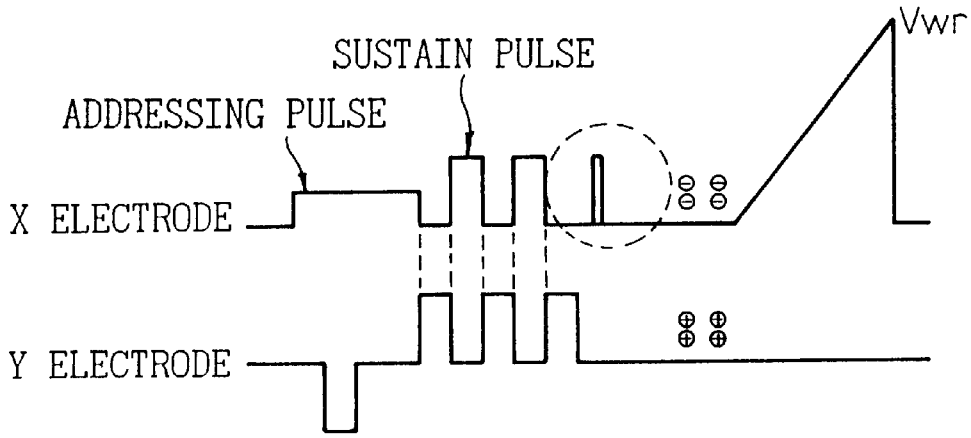
FIG. 13 is a driving voltage waveform diagram showing a third concrete example for forming the wall charges having a negative polarity relatively to a write pulse of a ramp wave in the embodiment of the present invention shown in FIG. 10.

In the third concrete example shown in FIG. 13, the erase discharge is executed by applying a small width erase pulse (i.e., a short erase pulse), which has the same polarity as that of the slope write pulse (e.g., of the ramp waveform having the gentle slope shown in FIG. 10), to the same electrode (X electrode) to which the slope write pulse is applied, after the sustain discharge is executed. Because the erase discharge is executed by such a small width erase pulse, wall charges having the same polarity as that of the wall charges generated by the write slope pulse are allowed to remain.

Figure 14:
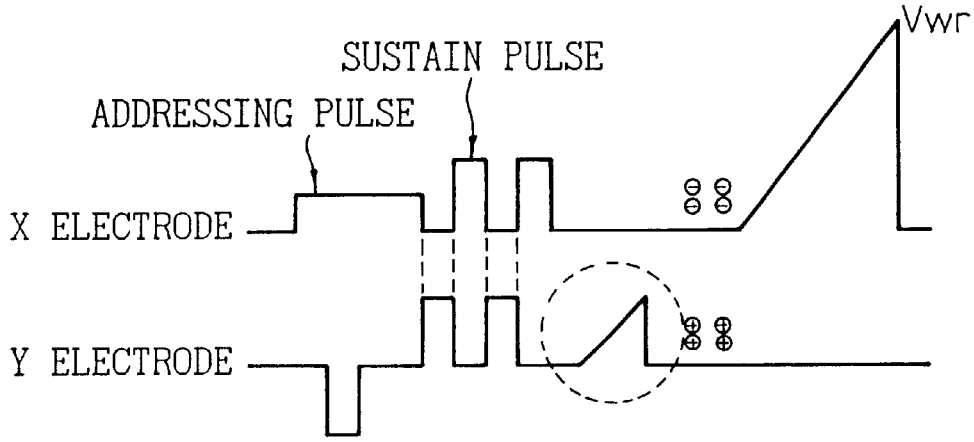
FIG. 14 is a driving voltage waveform diagram showing a fourth concrete example for forming the wall charges having a negative polarity relatively to a write pulse of a ramp wave in the embodiment of the present invention shown in FIG. 10.

In the fourth concrete example shown in FIG. 14, the erase discharge is executed by applying an slope erase pulse of a gentle slope, which has the same polarity as that of the slope write pulse (e.g., of the ramp waveform having a gentle slope, shown in FIG. 10) to the opposite electrode (Y electrode) to the electrode to which the slope write pulse is applied, after the sustain discharge is executed. Because the erase discharge is executed by such a slope erase pulse, the wall charges having the same polarity as that of the wall charges generated by the slope write pulse are allowed to remain.

Figure 15:
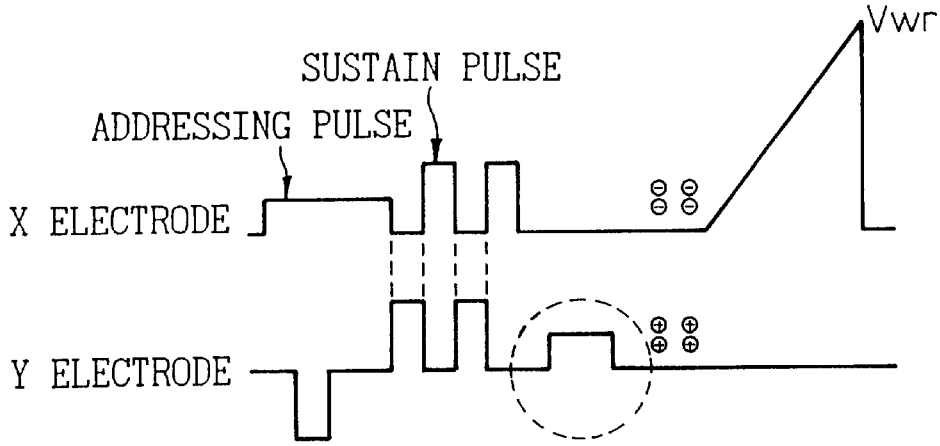
FIG. 15 is a driving voltage waveform diagram showing a fifth concrete example for forming the wall charges having a negative polarity relatively to a write pulse of a ramp wave in the embodiment of the present invention shown in FIG. 10.

In the fifth embodiment shown in FIG. 15, the erase discharge is executed by applying a large width erase pulse, which has the same polarity as that of the slope write pulse (e.g., of the ramp wave form having a gentle slope, shown in FIG. 16) to the electrode (i.e., the Y electrode) opposite to the electrode (i.e., the X electrode) to which the write slope pulse is applied, after the sustain discharge is executed. Because the erase discharge is executed by such a large width erase pulse, wall charges having the same polarity as that of the wall charges generated by the slope write pulse are allowed to remain.

Figure 16:
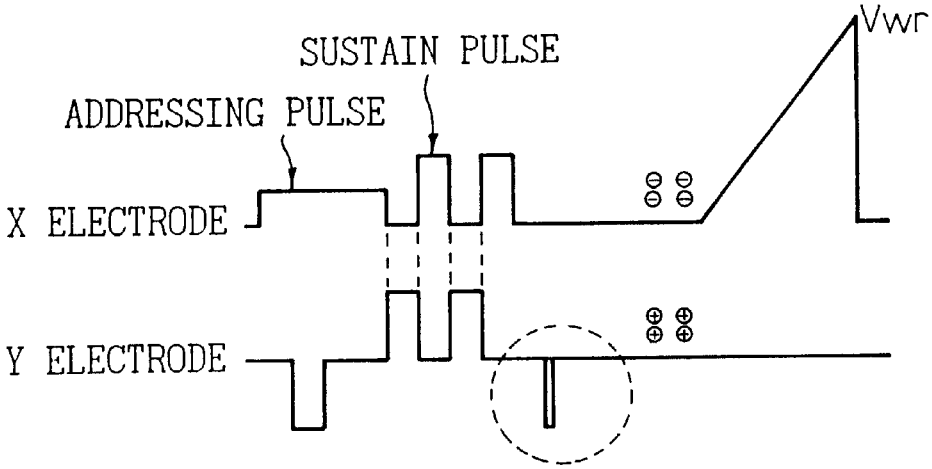
FIG. 16 is a driving voltage waveform diagram showing a sixth concrete example for forming the wall charges having a negative polarity relatively to a write pulse of a ramp wave in the embodiment of the present invention shown in FIG. 10.

In the sixth concrete example shown in FIG. 16, the erase discharge is executed by a applying a small width erase pulse, which has an opposite polarity relatively to that of the slope write pulse (e.g., of the ramp waveform having a gentle slope, as shown in FIG. 16) to the electrode (i.e., the Y electrode) which is opposite to the electrode (i.e., the X electrode) to which the slope write pulse is applied, after the sustain discharge is executed. Because the erase discharge is executed by such a small width erase pulse, the wall charges having the same polarity as that of the wall charges generated by the slope write pulse are allowed to remain.

Figure 17:
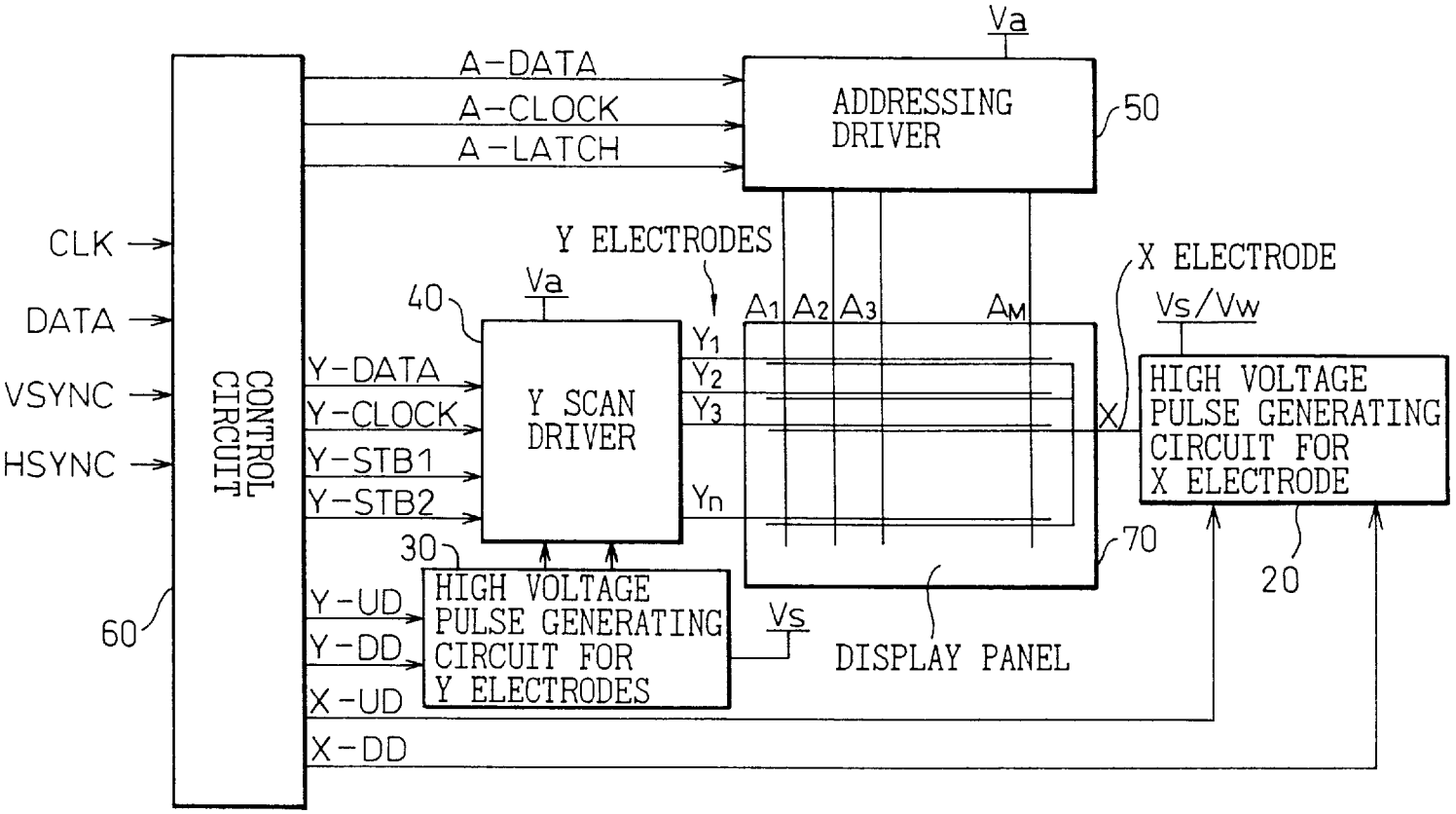
FIG. 17 is a block diagram showing the schematic construction of an apparatus for driving a plasma display panel to which the driving method according to the present invention is applied.

FIG. 17 is a block diagram showing a schematic construction of the apparatus for driving the plasma display panel to which the driving methods of the embodiments of the present invention are applied.

The driving methods according to the embodiments of the present invention are preferably applied to a display panel comprising a three-electrode surface discharge type AC plasma display panel, and are preferably applied to the driving sequence comprising the frames each having a plurality of subframes and including the reset discharge, the addressing discharge and the sustain discharge.

Referring to FIG. 17, reference numeral 60 denotes a control circuit. This circuit 60 controls the supply sequence of various driving voltage pulses to a display panel 70 for executing the reset discharge, the address discharge and the sustain discharge on the basis of a transfer clock CLK, a display data DATA, a vertical sync signal VSYNC and a horizontal sync signal HSYNC that are supplied from outside. In FIG. 15, further, a high voltage pulse generating circuit 20 for the X electrodes, that supplies the priming pulse and the sustain pulse to the X electrodes (X), a Y scan driver 40 for supplying a scan pulse to the Y electrodes (Y1 to Yn), a high voltage pulse generating circuit 30 for the Y electrodes, that supplies the driving voltage pulses other than the scan pulse to the Y electrodes, and an addressing driver 50 for supplying the addressing pulses to addressing electrodes (A1 to Am) are provided further to the plasma display panel driving apparatus.

The addressing driver 50 serially selects the addressing electrodes A1 to Am in accordance with the display data A-DATA, the transfer clock A-CLOCK and the latch clock A-LATCH from the control circuit 60 and applies the voltage Va.

Further, the high voltage pulse generating circuit 20 for the X electrodes, the Y scan driver 40 and the high voltage pulse generating circuit 30 for the Y electrodes drive the Y electrodes Y1 to Yn and the X electrodes at predetermined voltages (Vw, Vs, Va, etc) in accordance with an X up-drive signal X-UD, an X down-drive signal XDD, a scan data Y-DATA, a Y clock Y-CLOCK, a first Y strobe Y-STB1, a second Y strobe Y-STB2, a Y up-drive signal Y-UD and a Y down-drive signal Y-DD from the control circuit 60.

In the plasma display panel driving apparatus according to the present invention shown in FIG. 17, the circuit construction of the high voltage pulse generating circuit 20 for the X electrodes (or the high voltage pulse generating circuit 30 for the Y electrodes) is improved so that two kinds of priming pulses can be generated comprising (1) a high voltage priming pulse, which is supplied only at the time of activation of the cells, and (2) a low voltage priming pulse which is supplied after the occurrence of the priming discharge at the time of activation of the cells.

Figure 18:
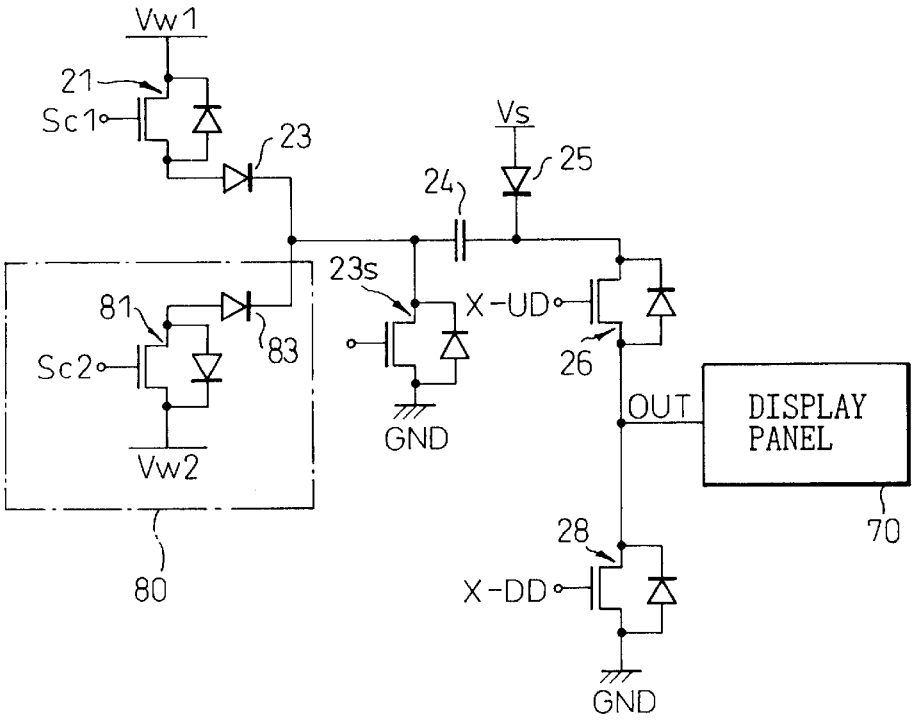
FIG. 18 is a circuit diagram showing a first concrete example of a circuit for generating two kinds of priming pulses.

FIG. 18 is a circuit diagram showing a first concrete example of the circuit for generating two kinds of priming pulses described above, and FIGS. 19A and 19B are driving voltage waveform diagrams showing the changes of the priming pulse potentials in the circuit shown in FIG. 18. However, FIG. 18 shows the construction of the principal portions of the high voltage pulse generating circuit 20 for the X electrodes.

Figure 19A:
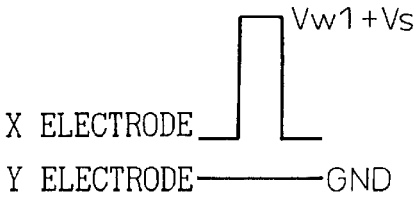
FIGS. 19A and 19B are driving voltage waveform diagrams showing the changes of a priming pulse potential in the circuit shown in FIG. 18.
Figure 19B:
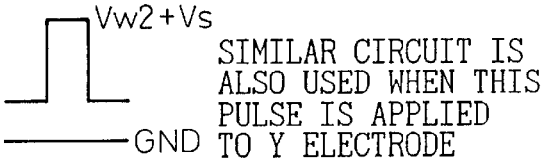

Referring to FIG. 18, a high voltage priming pulse generating portion for generating the high voltage priming pulse (voltage Vw1+Vs) at the time of activation of the cells such as the one shown in FIG. 19A includes a switching device 21 such as a transistor, high voltage clamping diodes 23 and 25, and a capacitor 24 for transferring the high voltage priming pulse. Further, a line for transferring the high voltage priming pulse is connected to the ground potential GND through a switching device 23*s* in such a manner as to charge the voltage Vs to the capacitor 24.

On the other hand, a low voltage priming pulse generating portion 80 for generating a low voltage priming pulse (voltage Vw2+Vs: Vw1>Vw2) after the priming discharge at-the time of activation of the cells shown in FIG. 18B includes a switching device 82 such as a transistor and a voltage clamping diode 83. These switching devices 21, 23 and 81 typically comprise a switching FET (the abbreviation for field effect transistor), and a diode inside each of these FETs is shown in the drawing.

Referring further to FIG. 18, there are shown disposed output switching devices 26 and 28 for supplying the voltage Vw2+Vs or Vw1+Vs or Vs or the ground potential GND to the X electrodes on the basis of the X up-drive signal X-UP and the X down-drive signal X-DD from the control circuit 20. Each of these switching devices 26 and 28 comprises a switching FET, too, and the diode inside each FET is shown in the drawing. The operation of the high voltage priming pulse generating portion and the operation of the low voltage priming pulse generating portion can be switched by inputting priming pulse switching control signals Sc1 and Sc2 from the control circuit 20 to the switching devices 21 and 81, respectively. For example, the high voltage priming pulse generating portion is operated by turning on the switching device 21 at the time of activation of the cells, and the potential of the high voltage priming pulse (first priming pulse) is supplied, as shown in FIG. 19A. In contrast, after the priming discharge at the time of activation of the cells is executed, the low voltage priming pulse generating portion is operated by turning on the switching device 81, and the-potential of the low voltage priming pulse (second priming pulse) is supplied.

Though the explanation has thus been given about the construction of the high voltage pulse generating circuit 20 for the X electrodes when two kinds of priming pulses are applied to the X electrodes, two kinds of priming pulses can be applied likewise to the Y electrodes by using the high voltage pulse generating circuit for the Y electrodes which has the same construction as the high voltage pulse generating circuit 20 for the X electrodes.

Figure 20:
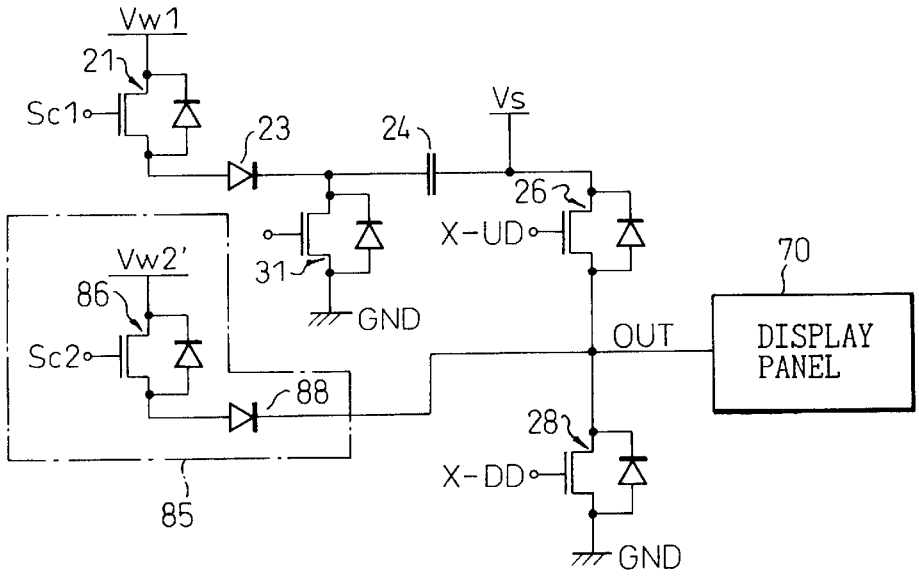
FIG. 20 is a circuit diagram showing a second concrete example for generating two kinds of priming pulses.

FIG. 20 is a circuit diagram showing a second concrete example of the circuit for generating two kinds of priming pulses.

In FIG. 20, a high voltage priming pulse generating portion having the same construction as that of the high voltage priming pulse generating portion shown in FIG. 15 is shown disposed. Further, since the line for transferring the high voltage priming pulse is connected to the ground potential GND through the switching device 31, the voltage Vs is charged to the capacitor 24.

In FIG. 20, further, a low voltage priming pulse generating portion 85 for generating the low voltage priming pulse after the priming discharge at the time of activation of the cells includes a switching device 86 such as a transistor and a voltage clamping diode 88. This low voltage priming pulse generating portion 85 is directly connected to the output terminal (OUT) in this case unlike the case shown in FIG. 18. Here, each of the switching devices 31 and 86 comprises a switching FET in the same way as the switching device 21, and the diode inside each FET is shown in the drawing.

In FIG. 21, further, the output switching devices 26 and 28 are disposed in the same way as in FIG. 18.

The operation of the high voltage priming pulse generating portion and the operation of the low voltage priming pulse generating portion can be switched by inputting the priming pulse switching control signals Sc1 and Sc2 from the control circuit 20 to the switching devices 21 and 86, respectively. In this case, however, the low voltage priming pulse having the voltage Vw2, which is generated by the low voltage priming pulse generating portion, is directly supplied to the X electrodes.

In this case, too, an explanation has been given of the construction of the high voltage pulse generating circuit 20 for the X electrodes when two kinds of priming pulses are applied to the X electrodes. When the priming pulses are applied to the Y electrodes, too, two kinds of priming pulses can be applied by using the high voltage pulse generating circuit for the Y electrodes that has the same construction.

Figure 21A:
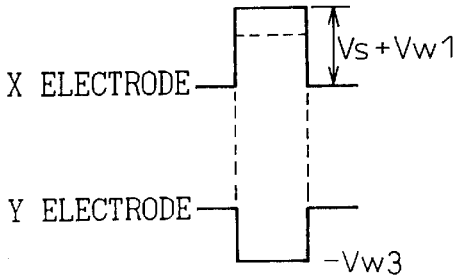
FIGS. 21A and 21B are driving voltage waveform diagrams showing a method for generating two kinds of priming pulses without adding an X electrode side pulse circuit.
Figure 21B:
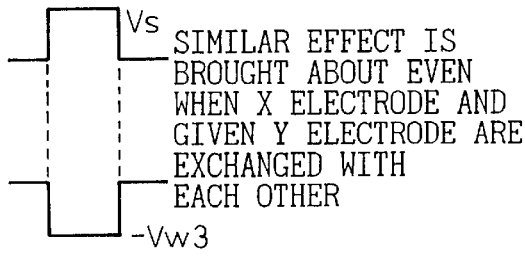

FIGS. 21A and 21B are driving voltage waveform diagrams showing a method for generating two kinds of priming pulses without adding the pulse circuit to the X electrode side.

In this case, only the high voltage priming pulse generating portion for generating the high voltage priming pulses (voltage Vs+Vw1) at the time of activation of the cells is disposed inside the high voltage pulse generating circuit 20 for the X electrodes, and the voltage −Vw3 having the opposite polarity inside the high voltage pulse generating circuit 30 for the Y electrodes is-used in common with the Y scan pulse voltage. In this way, two potentials can be provided when the voltage Vw1 is superposed with the voltage Vs (see FIG. 21A) and when the voltage Vw1 is not superposed with the voltage Vs (see FIG. 21B).

In summary, in the method for driving the plasma display panel according to a first aspect of typical embodiments described above of the present invention, each of a plurality of frames that together form the display screen in the plasma display panel comprises a plurality of subframes having respective different predetermined luminance, each of the subframes has a period in which the selective address discharge is executed and a period in which the sustain discharge is executed after the selective address discharge, and the priming discharge is executed only once for all the cells of at least one display line for at least two subframes or for at least two frames.

In the method for driving a plasma display panel according to a second aspect of typical embodiments of the present invention, each of a plurality of frames forming the display screen in the plasma display panel comprises a plurality of subframes, each of these subframes includes a period in which the selective address discharge described above is executed and a period in which the sustain discharge is executed after the selective address discharge, and the priming discharge is executed at least once for all the cells of at least one display line for each frame whereas the self-erase discharge is executed for only those cells which have executed the sustain discharge.

Preferably, in the method for driving a plasma display panel according to the second aspect of the typical embodiments of the present invention, a pulse having the same polarity as that of the write pulse, which is applied for executing the self-erase discharge, so as to allow the charges having a polarity opposite to that of the write pulse applied for executing the self-erase discharge to remain, to the cells which have executed the sustain discharge, as the wall charges which are caused to remain and are formed by the priming discharge.

Preferably, further, in the method for driving a plasma display panel according to the second aspect of the typical embodiments of the present invention, a pulse having a polarity opposite that of to the write pulse for the self-erase discharge is applied as the final pulse for the sustain discharge.

Preferably, further, in the method for driving a plasma display panel according to the second aspect of the typical embodiments of the present invention, the voltage of the write pulse applied for generating the self-erase discharge is set to a voltage higher than that of the voltage for executing the sustain discharge but lower than the voltage for executing the priming discharge for each frame. Further, in the method for driving a plasma display panel according to a third aspect of the typical embodiments of the present invention, each of a plurality of frames forming the display-screen in the plasma display panel comprises a plurality of subframes having mutually different luminances, each of these subframes has a period in which the selective address discharge is executed and a period in which the sustain discharge is executed after the selective address discharge, and when the priming discharge is executed by applying a slope write pulse (of a waveform of a gentle slope) as a priming pulse to the first or second electrode for all the cells of the selected display line for each subframe or for each frame, wall charges having a polarity opposite to that of the slope write pulse are allowed to remain until a point immediately before a priming discharge.

Preferably, further, in the method for driving a plasma display according to the third aspect of the typical embodiments of the present invention, the erase discharge is executed by applying a slope erase pulse having a waveform of a gentle slope and having a polarity opposite to that of the slope write pulse, described above, to the same first or second electrode to which the slope write pulse is applied, after the sustain discharge is executed.

Preferably, further, in the method for driving a plasma display panel according to the fourth aspect of the typical embodiments of the present invention, the erase discharge is executed by applying a large width erase pulse having a polarity opposite to that of the slope write pulse (i.e., having the waveform of a gentle slope) to the same first or second electrode to which the slope write pulse is applied, after the sustain discharge is executed.

Preferably, further, in the method for driving a plasma display panel according to the fourth aspect of the typical embodiments of the present invention, the erase discharge is executed by applying a small width erase pulse, having the same polarity as that of the slope write pulse (i.e., having a waveform of a gentle slope) to the same first or second electrode to which the slope write pulse is applied, after the sustain discharge is executed.

Preferably, further, in the method for driving a plasma display panel according to the fourth aspect of the typical embodiments of the present invention, the erase discharge is executed by applying a slope erase pulse having the same polarity as that of the slope write pulse (and also having a waveform of a gentle slope) to a first or a second electrode different from the electrode to which the slope write pulse is applied.

Preferably, further, in the method for driving a plasma display panel according to the fourth aspect of the typical embodiments of the present invention, the erase discharge is executed by applying a large width erase pulse having the same polarity as that of the slope write pulse (e.g., of a waveform of a gentle slope) to a first or a second electrode different from the electrode to which the slope write pulse is applied, after the sustain discharge is executed.

Preferably, further, in the method for driving a plasma display panel according to the fourth aspect of the typical embodiments of the present invention, the erase discharge is executed by applying a small width erase pulse, having a polarity opposite to that of the slope write pulse, to a first or a second electrode, different from the electrode to which the slope write pulse is to be applied, after the sustain discharge is executed.

In the prior art systems, the priming discharge for all the cells (initialization discharge of the wall charges ) is made for each subframe. Further, the prior art systems have employed the driving method which effects the erase discharge for only those cells which have executed the sustain discharge, in order to reduce background light emission of the display screen. In this case, a small width erase pulse or a large width erase pulse is used as the erase pulse for effecting the erase discharge. However, the erase pulse of this type is extremely limited by the pulse width and the potential, is extremely affected by variance of the cell characteristics, and causes a reduction in the driving margin. The present invention employs the write discharge/self-erase discharge system free from such limitations and can generate the self-erase discharge for only those cells which have executed the sustain discharge. Therefore, the present invention can accomplish driving of the plasma display panel in a more stabilized way by reducing background light emission.

To reduce background light emission of the display screen, the present invention uses in some cases pulse slope write pulse as a priming pulse for the all-cell write discharge for all the cells in the priming discharge. Slope write of a gentle slope forms wall charges having a polarity opposite to the polarity when the discharge a small background light emission is repeated.

In other words, when the residual charges having a negative polarity are left with respect to the slope write pulse as a priming pulse the time during which this pulse is applied can be reduced by more than when the residual charges having the positive polarity are left. When the slope write pulse as a priming pulse is generated by providing the resistance to the output side of the driving circuit, stable driving of the plasma display panel can be accomplished by preventing a large drop due to the discharge.

In summary, the present invention can accomplish stable driving of the plasma display panel by preventing a rise of background light emission by the following methods:

(1) by separating the pulse which is applied at the time of activation of the cells at which any priming does not at all exist, from the pulse which is applied for executing the subsequent priming discharge;

(2) by optimizing the number of times of the-priming discharge for the frames;

(3) by generating the self-erase discharge for only those cells which have executed the sustain discharge; and (4) by leaving the charges having a negative polarity relative to that of the all-cell write pulse having a gentle slope.

As explained above the methods for driving a plasma display panel according to some preferred embodiments of the present invention apply in the first place, a priming pulse having a higher voltage than the discharge start voltage of the cells when the cells are activated, and apply a priming pulse of a low voltage when the priming discharge is subsequently executed. Therefore, the present invention can restrain the occurrence of a discharge which is larger than necessary, and can reduce background light emission.

The methods for driving a plasma display panel according to some preferred embodiments of the present invention execute, in the second place the priming discharge only once for at least two frames. Therefore, the present invention can restrain the occurrence of excessive power consumption, and can therefore reduce background light emission much more than in the prior art systems.

The methods for driving a plasma display panel according to some preferred embodiments of the present invention set, in the third place, the polarity of the residual charges of the priming discharge relatively to the negative polarity to the erase pulse and the wall charges generated by those cells, which have executed the sustain discharge, to the positive polarity to the polarity of the erase pulse, and execute the erase discharge for only those cells which are to execute the sustain discharge, by utilizing the wall charges. Therefore, the present invention can effectively utilize the wall charges and can reduce background light emission.

The methods for driving a plasma display panel according to some preferred embodiments of the present invention use, in the fourth place, the voltage slope write pulse as a priming pulse, and allow the wall charges immediately before the priming discharge to remain in the negative polarity relative to the waveform of a gentle slope when background light emission is reduced by repeating the priming discharge of small background light emission. In this way, the present invention can reduce the time during which the pulse is applied.

What is claimed is:

1. A method for driving an AC type plasma display panel comprising steps of:

arranging first electrodes and second electrodes adjacent to one another for each display line;

arranging third electrodes in such a manner as to cross said first and second electrodes; and repeating light emission display by utilizing a selective address discharge by either one of said first and second electrodes and by one of said third electrodes, and a sustain discharge executed repeatedly, wherein:

each of a plurality of frames, constituting a display in said plasma display panel, comprises a plurality of subframes respectively having predetermined luminances and each of said subframes having a period in which said selective address discharge is executed and a period in which said sustain discharge is executed after said selective address discharge, and has, on the other hand, a period in which a priming discharge is executed at least once per frame, and said priming discharge is executed by applying a pulse, having a voltage higher than a priming pulse for executing said priming discharge to be made after the activation of said cells, between said first and second electrodes only when said cells are activated.

2. A method for driving an AC type plasma display panel comprising the steps of:

arranging first electrodes and second electrodes adjacent to one another for each display line;

arranging third electrodes in such a manner as to cross said first and second electrodes; and repeating light emission display by utilizing a selective address discharge by either one of said first and second electrodes and by said third electrode, and a sustain discharge executed repeatedly, wherein:

each of a plurality of frames, constituting a display in said plasma display panel, comprises a plurality of subframes respectively having predetermined luminances and each of said subframes having a period in which said selective address discharge is executed and a period in which said sustain discharge is executed after said selective address discharge, and a priming discharge is executed only once for all of said cells, of at least one of the display lines for at least two of said frames.

3. A method for driving an AC type plasma display panel comprising the steps of:

arranging first electrodes and second electrodes adjacent to one another for each display line on a first substrate;

arranging third electrodes on a second substrate opposing said first substrate in such a manner as to cross said first and second electrodes; and repeating light emission display by utilizing a selective address discharge by either one of said first and second electrodes and by one of said third electrodes, and a sustain discharge executed repeatedly, wherein:

each of a plurality of frames, constituting a display in said plasma display panel, comprises a plurality of subframes respectively having predetermined luminances and each of said subframes having a period in which said selective address discharge is executed and a period in which said sustain discharge is executed after said selective address discharge, and a priming discharge is executed at least once for all of said cells, of at least one of the display lines for each frame, and a self-erase discharge is executed for only those of said cells which have executed said sustain discharge.

4. A method for driving an AC type plasma display panel according to claim 3, wherein charges having a polarity opposite to a polarity of a write pulse applied to those of said cells which have executed said sustain discharge, so as to execute said self-erase discharge, are allowed to remain as wall charges to be generated and left by said priming discharge.

5. A method for driving an AC type plasma display panel according to claim 3, wherein a pulse, having a polarity opposite to a polarity of a write pulse applied to execute said self-erase discharge, is applied as a last pulse of said sustain discharge.

6. A method for driving an AC type plasma display panel according to claim 3, wherein a voltage of a write pulse, applied for generating said self-erase discharges is set to a voltage higher than a voltage for executing said sustain discharge but lower than a voltage for executing said priming discharge for each frame.

7. A method for driving an AC type plasma display panel comprising the steps of:

arranging first electrodes and second electrodes adjacent to one another for each display line on a first substrate;

arranging third electrodes on a second substrate opposing said first substrate in such a manner as to cross said first and second electrodes; and repeating light emission display by utilizing a selective address discharge by either one of said first and second electrodes and by one of said third electrodes and a sustain discharge executed repeatedly, wherein:

each of a plurality of frames constituting a display in said plasma display panels comprises a plurality of subframes respectively having predetermined luminances and each of said subframes having a period in which a priming discharge is executed, a period in which said selective address discharge is executed after said priming discharge and a period in which said sustain discharge is executed after said selective address discharge, and when said priming discharge is executed by applying a waveform having a gentle slope to said first or second electrodes, for all of said cells of a selected display line and for each of said subframes or for each of said frames, wall charges having a polarity opposite to a polarity of said waveform having a gentle slope are allowed to remain until immediately before said priming discharge.

8. A method for driving an AC type plasma display panel according to claim 7 wherein, after said sustain discharge is executed, an erase discharge is executed by applying an erase pulse, having a gentle slope and a polarity opposite to the polarity of said waveform having a gentle slope, to said first or to said second electrode to which said waveform having a gentle slope is applied.

9. A method for driving an AC type plasma display panel according to claim 7, wherein, after said sustain discharge is executed, an erase discharge is executed by applying a large width erase pulse, having a polarity opposite to the polarity of said waveform having a gentle slope, to said first or to said second electrode to which said waveform having a gentle slope is to be applied.

10. A method for driving an AC type plasma display panel according to claim 7 wherein, after said sustain discharge is executed, an erase discharge is executed by applying a small width erase pulse, having the same polarity as the polarity of said waveform having a gentle slope, to said first or to said second electrode to which said waveform having a gentle slope is to be applied.

11. A method for driving an AC type plasma display panel according to claim 7 wherein, after said sustain discharge is executed, an erase discharge is executed by applying an erase pulse, having a gentle slope and the same polarity as the polarity of said waveform having a gentle slopes to said first or to said second electrode different from said electrodes of which said waveform having a gentle slope is to be applied.

12. A method for driving an AC type plasma display panel according to claim 7 wherein, after said sustain discharge is executed, an erase discharge is executed by applying a large width erase pulse, having the same polarity as the polarity of said waveform having a gentle slope, to said first or to said second electrode different from said electrodes to which said waveform having a gentle slope is to be applied.

13. A method for driving an AC type plasma display panel according to claim 7 wherein, after said sustain discharge is executed, an erase discharge is executed by applying a small width erase pulse, having a polarity opposite to the polarity of said waveform having a gentle slope, to said first or to said second electrode different from said electrodes to which said waveform having a gentle slope is to be applied.

* * * * *